US011796261B2

(12) United States Patent
Neumann

(10) Patent No.: US 11,796,261 B2
(45) Date of Patent: Oct. 24, 2023

(54) INTERMEDIATE PRODUCT FOR THE PRODUCTION OF A SURFACE HEAT EXCHANGER AND THE SAME

(71) Applicant: Schmöle GmbH, Fröndenberg (DE)

(72) Inventor: Till Neumann, Iserlohn (DE)

(73) Assignee: SCHMÖLE GMBH, Fröndenberg (DE)

( * ) Notice: Subject to any disclaimer, the term of this patent is extended or adjusted under 35 U.S.C. 154(b) by 151 days.

(21) Appl. No.: 17/590,268

(22) Filed: Feb. 1, 2022

(65) Prior Publication Data

US 2022/0252360 A1 Aug. 11, 2022

(30) Foreign Application Priority Data

Feb. 5, 2021 (DE) ..... 20 2021 100 591.2

(51) Int. Cl.
*F28F 9/16* (2006.01)

(52) U.S. Cl.
CPC ..... *F28F 9/162* (2013.01); *F28F 2275/025* (2013.01)

(58) Field of Classification Search
CPC .... F28F 9/162; F28F 2275/025; F24D 13/024
USPC ..... 165/79
See application file for complete search history.

(56) References Cited

U.S. PATENT DOCUMENTS

| | | | | |
|---|---|---|---|---|
| 2,625,378 | A * | 1/1953 | Nason | F25D 23/061 165/169 |
| 5,454,428 | A * | 10/1995 | Pickard | F24D 3/148 165/49 |
| 6,910,526 | B1 * | 6/2005 | Sokolean | F24D 3/165 165/56 |
| 8,561,677 | B2 * | 10/2013 | Miyamura | F24F 5/0092 165/168 |
| 10,386,123 | B2 * | 8/2019 | Garcia Martin | F28F 1/00 |

FOREIGN PATENT DOCUMENTS

| | | | |
|---|---|---|---|
| CH | 707238 | A1 | 5/2014 |
| DE | 102015008082 | A1 | 12/2016 |
| EP | 0769659 | A1 | 4/1997 |
| WO | 2018071612 | A1 | 4/2018 |

OTHER PUBLICATIONS

European Search Report dated Jun. 23, 2022, 1 Page.

* cited by examiner

*Primary Examiner* — Jon T. Schermerhorn, Jr.
(74) *Attorney, Agent, or Firm* — LUCAS & MERCANTI, LLP; Klaus P. Stoffel

(57) ABSTRACT

An intermediate product for the production of a surface heat exchanger, in particular for building room air conditioning, including a support plate, on one side of which a tube system for conducting a medium is attached and on the other side of which a prefabricated adhesive tape having a manually removable outer protective layer is arranged, wherein the adhesive tape is free of any support.

24 Claims, 4 Drawing Sheets

12
11

14a
14b
13
15a
Ic'
Ic'
15b
14d
14c
15c 33
16a
16b
16d
16c

16a
II
II
11
15
10
16d 10
20
18
31
17
19

16
35
34
33
30
35'
30'

INTERMEDIATE PRODUCT FOR THE PRODUCTION OF A SURFACE HEAT EXCHANGER AND THE SAME

CROSS-REFERENCE TO RELATED APPLICATIONS

The present application claims priority of DE 20 2021 100 591.2, filed Feb. 5, 2021, the priority of this application is hereby claimed and this application is incorporated herein by reference.

BACKGROUND OF THE INVENTION

The present invention first relates to an intermediate product for the production of a surface heat exchanger.

Intermediate products of this kind are known from the prior art in principle, for example from DE 10 2015 008 082 A1 by the applicant. This document describes an intermediate product which can be adhered in a retaining cassette or what is known as a "sail", wherein the retaining cassette is in turn attached to a ceiling or wall of a building wall, for the air conditioning thereof. The side of the retaining cassette facing the inside of the room thus conceals or covers the intermediate product attached to the other side of the retaining cassette.

In this case, the intermediate product may in particular be produced at a different site from the retaining cassette and can then be brought to the installation site in order to only be adhered to the retaining cassette here.

Therefore, the intermediate product comprises a protective layer covering the adhesive layer of the intermediate product, in particular for transport.

The adhesive layer is located on the intermediate product on a first side of a support plate, wherein a tube system is fixed to the other, opposite side of the support plate, in particular by means of a heat-conducting element. A cool or heated medium later flows through the tube system when a surface heat exchanger is installed and assembled.

In the prior art, it may in principle be the case that cavities form between the adhesive layer and the protective layer, which cavities may in particular counteract a subsequent adhesive effect.

Therefore, it is also known from said prior-art document to provide an adhesive tape which already has an (integrated) protective layer, instead of a manually applied adhesive layer and a separate protective layer.

Double-sided adhesive tapes of this kind typically consist of a central support, which is coated on both sides with adhesion promoter (known as primer) in order to retain an adhesive mass on either of its sides. A corresponding, removable protective layer is then positioned on the outside of at least one of the adhesive masses.

Even if a solution of this kind has proven to be very easy to handle and advantageous in practice, a person skilled in the art is always seeking a further optimised intermediate product and surface heat exchanger.

SUMMARY OF THE INVENTION

The invention solves the stated problem by means of the intermediate product having a support plate on one side of which a tube system for conducting a medium is attached and on the other side of which prefabricated adhesive tape having a manually removable outer protective layer is arranged, wherein the adhesive tape used is free of any support.

In other words, the concept of the invention is to use what is known as a transfer adhesive tape as a prefabricated adhesive tape of an intermediate product.

Although transfer adhesive tapes of this kind are known from the prior art in principle, their use in surface heat exchangers (or at least intermediate products for the production of surface heat exchangers) is not.

Here, the applicant has found that departing from the basic teaching of using the most robust and stable possible double-sided adhesive tape comprising a support provides the essential advantage of yet further improved heat transfer between the support plate and the retaining cassette, wherein the use of a support-free transfer adhesive tape that is actually more delicate (and therefore not so stable and robust) is actually an obstacle to the primary goal of the most secure possible retention.

Extensive series of tests have, however, demonstrated that, contrary to expectations, the use of a support-free (transfer) adhesive tape is sufficiently secure and also provides considerably improved heat-conducting properties.

The heat-conducting properties of a tape of this kind are more advantageous since heat transferred between the support plate and the tube system or the retaining cassette does not have to be additionally transported through the support, layer or core.

The support-free adhesive tape also has a lower thickness overall, such that the transfer or transport path for the heat or temperature properties is also shorter and therefore optimised.

While prior-art adhesive tapes used until now therefore comprise a support made of paper, non-woven material, film, foam, composite material or similar, the adhesive tape used according to the invention advantageously merely consists of an adhesive body and a protective layer covering this on one side, for example made of (special) paper, film or similar.

In particular, a support is not provided. Advantageously, however, the adhesive tape is also free of primer.

The adhesive tape is typically in one piece and, for producing the intermediate product, can have been peeled off and detached from a roll or a corresponding stamped part in the manner of a roll, for example, or can also have been detached from a sheet, or the like.

In this sense, "prefabricated" in particular means that the adhesive tape is substantially in the form of a prepared body, preferably already comprises a protective layer and forms a unit together with said layer.

As described, this unit may previously have been detached from a roll or sheet, or the like.

Therefore, according to the invention this is a double-sided adhesive tape (also called double-faced adhesive tape) which does not comprise a support.

In particular, it is crucial that the adhesive tape, with the exception of the protective layer, is continuously adhesive, i.e. does not comprise a non-adhesive core.

This may therefore be transfer adhesive tape, which merely consists of an adhesive film together with a protective layer, or may also be foam adhesive tape, which, again with the exception of the protective layer, completely consists of adhesive mass (in the latter case, the adhesive tape may exclusively consist of foam and the protective layer or of self-adhesive foam plus additional adhesive film and the protective layer).

Adhesive tapes of the first type, i.e. those which merely comprise an adhesive film together with a protective layer, are particularly advantageous, however, since they are in particular provided with particularly good heat-conducting properties.

Merely for the sake of clarity, it is noted that, before they are added to the intermediate product, the adhesive tapes used in the intermediate product according to the invention of course can also still be provided on the other side, in addition to the outer protective layer, with another protective layer (for example in the manner of a separation layer or the like) (known as a liner), which essentially prevents adhesive tape on a roll or elsewhere from adhering to the layer thereabove. Liners of this kind can of course no longer be found in an intermediate product, since, if present, they have been peeled off before the adhesive tape has been attached to the intermediate product or adhered to the support plate.

The outer protective layer may in particular be silicone paper, since this is particularly suitable for effectively protecting the adhesive body or adhesive film and can also still be manually peeled off after a long period of time.

Merely for the sake of clarity, with regard to the protective layer, it is also noted that the protective layer can of course be formed in one piece or alternatively in multiple pieces (for example consisting of a plurality of strips arranged beside one another, or the like).

By peeling off or removing the protective layer, the adhesive body of the adhesive tape is exposed and the remainder of the intermediate product (i.e. the intermediate product without the protective layer) can then be adhered to the retaining cassette. For this purpose, the retaining cassette typically has an attachment face in its interior which is designed to be flat.

Typically, precisely one surface heat exchanger is attached in a retaining cassette in this case. In alternative embodiments, however, it is also possible to insert two or more surface heat exchangers into one retaining cassette, wherein the surface heat exchangers are preferably fluidically connected to one another in this case.

Retaining means for fastening to a wall or ceiling of a building room can be associated with the retaining cassette in a conventional manner. In addition, depending on the customer's requirements and the use, a cassette may also comprise what are known as acoustic perforations. In this sense, the cassette is not designed to be closed, but instead has perforations, which are typically arranged regularly and in a grid, on the surface thereof, i.e. in particular in the region of the attachment face. In this case, it is useful for the intermediate product to be inserted into the retaining cassette to likewise comprise congruent perforations, in any case in the region of the support plate and optionally in the region of the adhesive tape/body. In particular, the protective layer does not need to comprise these perforations, since it is removed or taken off before assembly of the surface heat exchanger.

A surface heat exchanger produced in this way is usually installed together with a plurality of identical surface heat exchangers on a ceiling or wall of a building, without joints as far as possible, in order to give a homogeneous appearance. The tube systems of the individual surface heat exchangers can be fluidically connected here, in particular also by openings in the side walls of the retaining cassette or the like.

This plurality of surface heat exchangers can also be referred to as a climate-control ceiling or climate-control wall. It is used for air conditioning the room, i.e. in particular for heating or cooling the room.

If a heating effect is desired, a hot medium, in particular water, is typically directed through the tube system. If cooling is desired, a cold medium, likewise preferably (cooled) water, is directed therethrough. The tubes in particular consist of copper here, but may also consist of any other suitable metal or another material, such as a suitable plastics material. Typically, the tubes of a single surface heat exchanger have a meandering shape here, i.e. they consist of straight portions and curved portions. Advantageously, the straight portions have a D shape in cross section and the round portions have a circular shape in cross section.

The tube system is typically fastened to the support plate by means of heat-conducting sheets, which are either adhered to the support plate (preferably likewise by support-free adhesive tape) or fastened thereto in another, in particular mechanical, manner (e.g. in an interlocking manner). In particular, a plurality of strip-like heat-conducting sheets may be provided, which are also in particular associated with the straight tube portions and engage over said tube portions so as to be fastened on either side or at least on one side.

In order to install the surface heat exchanger, as already described, the protective layer can be removed from the intermediate product and said product can then be manually adhered, in particular by applying pressure, to the attachment face of the retaining cassette over its entire surface and fully.

The retaining cassette typically consists of metal or steel and may in particular also be magnetic. It is also referred to as a sail and the heat exchanger using it is also referred to as a heat exchanger of the cassette type. The heat-conducting sheet(s) generally consist(s) of materials having good heat-conducting properties, such that a heat-conducting function is in particular provided in order to transfer the temperature of the medium to the support plate. In addition to this heat-conducting function, the heat-conducting sheet of course also has the function of fixing the tube system (or a portion of the tube system) and simultaneously pressing on the support plate with constant tension. Therefore, the heat-conducting sheet is typically made of spring-hard metal.

Owing to the in particular at least 3 mm thick metal support plate (steel can optionally also be used), the temperature can be transferred in a more optimised manner. Preferably, the metal support plate has a thickness of at least 0.5 mm and more preferably of at least 0.6 mm. Metal sheets that are too thin, as are known for example from the different field of refrigerator technology, cannot be used, since on one hand they bend easily and on the other hand they do not allow for proper heat transfer, and this is, however, particularly important in surface heat exchangers from the field of building air conditioning.

In the surface heat exchanger that is used and assembled in the present case, the support plate, together with the tube system and the heat-conducting sheet, is associated with the inner face of the cassette facing away from the room.

According to a particularly advantageous embodiment of the method according to the invention, the support plate consists of aluminium, which allows for particularly good thermal conductivity.

According to another advantageous embodiment of the method according to the invention, the outer protective layer, which covers the adhesive layer, is provided in the form of a film or sheet and can be peeled off manually without tools. The protective layer may thus be a film or may also be a piece of (silicone) paper or the like which is suitable for being manually peeled off the adhesive body of the adhesive tape.

Advantageously, it is provided that the protective layer comprises a peel-off face or grip face. In the simplest case, this peel-off face may be the rear side of the protective layer, behind which a finger nail can engage, for example. In this sense, the protective layer can be easily peeled off and then engaged from behind at a corner, for example. Advantageously, however, it may also alternatively be provided that the protective layer protrudes slightly beyond the adhesive body in order to provide the user with a grip face. Alternatively, however, the protective layer may of course also provide a separate tab, in particular in a corner region, which makes it easier to peel off or remove the protective layer.

According to a particularly advantageous embodiment of the invention, after removal of the protective layer, the support plate is black in appearance on its side having the adhesive layer. This provides visual advantages, in particular if the support plate together with the tube system (i.e. the remainder of the intermediate product once the protective film is peeled off) is intended to be directly adhered to the retaining cassette (i.e. without a black non-woven material therebetween).

This embodiment of the invention is suitable in particular for cases in which the retaining cassette is not closed in the region of its attachment face, but is perforated, and non-woven material is not used, as described. The effect of a black colour may be achieved here by a separate layer underneath a transparent adhesive tape, for example. Alternatively, however, a black-coloured adhesive tape can of course also be used.

According to another advantageous embodiment of the invention, the retaining cassette has a width and a length of respectively at least 50 cm. Retaining cassettes having smaller dimensions have proven to be unsuitable for the installation, in particular for visual reasons but also for reasons of ease of installation and stability.

Typical retaining cassettes have a width and a length of approximately 60 cm. Alternative, non-square retaining cassettes oriented in a somewhat elongate manner may have dimensions of 60×120 cm, for example.

In order to be inserted into retaining cassettes having these dimensions, the support plates of the intermediate product typically have dimensions having edge lengths of approximately 30 to 120 cm. Typically, the edge length of the corresponding support plate must be at least somewhat smaller than the edge length of the retaining cassette, such that the support plate and therefore the remainder of the intermediate product after peeling off the protective layer can be inserted into the retaining cassette without any problems.

Typical support plates have dimensions of 30×30 cm to 50×50 cm, for example. For larger sails, however, larger support plates can of course also be provided. Both edge lengths are, however, typically at least 20 cm or 30 cm, but typically probably do not exceed 250 cm in length/width.

In particular, after removal of the protective layer, the intermediate product is adhered to the attachment face undeformed. In this sense, after removal of the protective layer, this is in fact, strictly speaking, not the intermediate product, but rather the remainder of the intermediate product. For the sake of comprehension, however, this will (just) be referred to as an intermediate product in this case. In any case, the remainder of the intermediate product or the support plate is adhered to the attachment face undeformed, such that, for example, the support plate is not bent, angled or the like for this purpose. Owing to the greater material thickness, this is also generally not even possible. Since the support plate together with the adhesive body of the adhesive tape extends substantially along a plane, the support plate is also adhered to the planar attachment face substantially along a plane.

Preferably, the remainder of the intermediate product is adhered to the attachment face substantially over its entire surface, wherein it is possible, for example, to provide that the adhesive body is attached to the support plate continuously and without gaps.

Alternatively, the adhesive body of the adhesive tape may however also comprise perforations or the like, in particular if perforations are likewise provided either in the attachment face of the retaining cassette and/or on the support plate. Within the meaning of the present invention, however, this is still considered to be substantially over the entire surface. This is in particular understood to mean that the adhesion is not just carried out at points.

According to the invention, it may be advantageous for the support plate to only comprise a substantially continuous adhesive body on one side for this purpose. A continuous adhesive body is therefore not provided on the other side, associated with the tube system. Although the heat-conducting sheets can be fastened to the other side using adhesive or adhesive tape, this is generally only in a strip-like manner and not continuously.

According to the invention, the side of the intermediate product or the remainder of the intermediate product comprising the adhesive layer is preferably adhered plane parallel with the attachment face. In this sense, two faces, which substantially extend along a parallel plane, namely the attachment face and the adhesive tape or the underside of the support plate, are moved towards one another in as parallel a manner as possible such that the two planes come to lie on top of one another. A user can then help the two faces to adhere manually by applying pressure.

Advantageously, both said side of the intermediate product and/or said side of the support plate and the attachment face do not comprise any recesses for this purpose, although minor perforations, in particular grid-shaped acoustic perforations, can be provided. Recesses in the sense that either the attachment face or the support plate comprises regions in the manner of deep-drawn, set-back regions would, however, probably not allow for full adhesion.

According to another, particularly advantageous embodiment of the invention, the adhesive tape is substantially free of cavities in the region between the protective layer and the adhesive body.

This is in particular intended to constitute a distinction from a manually attached adhesive layer disclosed in the prior art, which is then provided with a separate protective layer. Here, the surface of the adhesive layer may namely in particular be inhomogeneous and the planar or smooth protective layer may not cling to the adhesive layer in a planar manner, meaning that said cavities develop.

The invention therefore provides the advantage that a prefabricated adhesive tape is used in which cavities of this kind can be eliminated from the outset.

Here, "substantially free of cavities" means that there are no relevant cavities. In the microscopic sense, cavities may potentially be detected all over, but these are not what is meant. Instead, cavities are meant which can develop when there are separate adhesive layers that are attached manually or using a machine and are provided with a separate protective layer.

In this sense, the region between the protective layer and the adhesive body can be free of cavities.

According to the most preferred embodiment of the invention, the adhesive tape consists of the protective layer and the adhesive body. It therefore neither comprises a support nor a primer or the like.

The adhesive body preferably has a thickness of less than 0.1 mm, more preferably of less than 0.07 mm, for example of 0.06 mm.

The adhesive body preferably has a thickness of greater than 0.01 mm, more preferably of greater than 0.05 mm.

More advantageously, the adhesive body may comprise or consist of acrylate adhesive. This may in particular be modified acrylate.

According to another embodiment, the adhesive body may also comprise or consist of foam. The adhesive body may in particular be acrylate foam, which is in particular designed to be continuously adhesive.

According to the most advantageous embodiment of the invention, the adhesive tape is designed as what is known as a transfer adhesive tape. This can in particular be understood to be a distinction from a double-sided adhesive tape comprising a support, as used in the prior art.

Overall, the adhesive tape may in particular have a total thickness of less than 0.2 mm, preferably of less than 0.15 mm, for example of approximately 0.14 mm.

The total thickness may preferably be greater than 0.1 mm.

In this sense, it can therefore be established that, according to the most preferred embodiment of the invention, the adhesive body can have a lower thickness than the protective layer.

According to the invention, the intermediate product may be designed such that exactly one prefabricated adhesive tape is provided on the side of the support plate on which the adhesive tape is arranged.

Alternatively, however, a plurality of, i.e. at least two, adhesive tapes may also of course be provided instead, for example provided that they are strip-shaped (and arranged beside one another).

According to a second aspect of the invention, the problem addressed is solved by a surface heat exchanger having an intermediate product comprising a support plate on one side of which a tube system for conducting a medium is attached and on the other side of which a prefabricated adhesive tape is arranged, which attaches the support plate in or on a retaining cassette, wherein the adhesive tape is free of any support.

In other words, this aspect of the invention relates to a surface heat exchanger in which an intermediate product according to the invention is adhesively bonded into a retaining cassette, of course once the protective layer has been removed.

The adhesive tape according to the invention therefore in particular does not comprise (or no longer comprises) a protective layer.

According to another aspect of the invention, the problem is solved by a surface heat exchanger in which the heat-conducting element is indirectly or directly attached to the support plate by means of a support-free adhesive tape. Also according to this aspect, the adhesive tape does not comprise (or no longer comprises) an outer protective layer.

The heat-conducting element may in particular be a heat-conducting sheet which is adhered to the support plate by a support-free adhesive tape or strip. In this case, the heat-conducting sheet may be directly adhered to the support plate or, for example, to a layer arranged thereon, in particular made of non-woven material.

Furthermore, the problem addressed by the invention is also solved by a surface heat exchanger in which both the adhesive tape for attaching the support plate in or on a retaining cassette and the adhesive tape for attaching the heat-conducting element to the support plate are designed as a support-free adhesive tape.

Therefore, both adhesive tapes can come from the same source, i.e. in particular the same roll, sheet or supply, or the like, and in particular can have an identical construction and/or an identical thickness.

Lastly, the problem addressed by the invention is also solved by a surface heat exchanger having an adhesive tape which attaches an outer decorative layer to the support plate is free of any support.

According to this aspect of the invention, the concept of the invention consists in an intermediate product being provided with a decorative layer after removing the protective layer (in the region from which the protective layer has been removed). The decorative layer is therefore in particular attached to the support plate by means of the support-free adhesive tape.

In this way, an intermediate product modified in such a way can be used directly as a surface heat exchanger (in particular inserted into an additional retaining cassette without the support plate).

This is in particular a non-metal decorative layer here.

In other words, the decorated support plate is used directly as a surface heat exchanger.

A surface heat exchanger provided in such a way is already sufficiently decorative in itself and therefore does not need to be additionally provided with plasterboard and/or filled.

Because a non-metal decorative layer is selected, the look can be sufficiently contrasted with the partially dull metal look of conventional metal cassettes.

Components can also be saved, since, in addition to the support plate, another, metal retaining cassette is not required.

In addition, however, this aspect of the invention can also cover the fact that the support plate is provided by a (conventional) retaining cassette.

According to the invention, the decorative layer is arranged on the outside of the surface heat exchanger, i.e. it constitutes an outer layer of the surface heat exchanger.

Therefore, the decorative layer is arranged such that an observer's view primarily falls on the decorative layer, at least in a possible viewing direction.

This effect is utilised to install the surface heat exchanger in a (building) room such that the outer decorative layer points towards the interior of the room, i.e. towards an observer who is in the room.

Within the meaning of the invention, a decorative layer constitutes a layer which looks visually more appealing, in particular in contrast with a blank support plate, retaining cassette or protective layer.

Typically, metal layers of support plates or retaining cassette are often perceived as being "cold".

The decorative layer may, however, have a more visually appealing effect, for example due to a pattern and/or its structure and/or its material selection.

In this sense, the decorative layer may for example have a pattern or a particular relief, but it does not have to. In particular, the decorative layer may have a decorative effect merely due to its structure or material.

Alternatively, the decorative layer may also be (decoratively) printed, i.e. may have a print, which may constitute a pattern (merely by way of example).

The decorative layer may typically be a flexible, flat body, i.e. for example a textile fabric or a material made of paper, cardboard, film or the like.

Particularly advantageously, the textile fabric or the decorative layer may consist of non-woven material, in particular an acoustic non-woven material, in this case.

Alternatively, however, a wallpaper, for example a textured wallpaper or a non-woven wallpaper or the like, may also be provided as the decorative layer.

In other words, the front side of the support plate can be "wallpapered" with a flat, in particular flexible, body using the support-free adhesive tape.

Advantageously, the decorative layer may provide a pattern, more advantageously a pattern which can continue onto other surface heat exchangers, which can preferably be arranged to be adjacent.

Within the meaning of the present invention, a "non-metal" design of the decorative layer means that it does not predominantly consist of metal; however, the decorative layer may contain minor metal elements, such as metal fibres.

In this case, the decorative layer may in particular consist of non-woven material, i.e. what is also known as a "non-woven". Preferably, the decorative layer is formed by an acoustic non-woven material, which, in this case, is in particular distinguished in that it has particularly effective acoustic absorbing properties.

In this case, the decorative layer may for example have an open-perforated surface area of at least 5%, furthermore at least 10%.

With regard to the surface heat exchanger, it is noted that all the claims, features and advantages described in connection with the intermediate product are of course also transferable to said surface heat exchanger and should be considered to be disclosed in conjunction therewith. Merely for the sake of clarity, these will not be explicitly repeated at this point in conjunction with the surface heat exchanger. The same of course also applies vice versa, i.e. with regard to the advantages described in relation to the surface heat exchanger with regard to the intermediate product.

An essential difference, also in relation to the thickness of the adhesive tape, is, however, that the claims directed to the surface heat exchanger all relate to adhesive tapes in which the protective layer has already been removed or which do not comprise (or no longer comprise) a protective layer, while the main claim relates to an adhesive tape having a protective layer still affixed thereto.

BRIEF DESCRIPTION OF THE DRAWING

Other advantages and embodiments of the invention become apparent from the dependent claims, which are not cited, and from the following description of the figures, in which:

FIG. 1*a* shows a support plate, FIG. 1*b* shows a tube system, FIG. 1*c* shows heat-conducting elements, FIG. 1*c*' shows an adhesive strip on a heat-conducting element of FIG. 1*c*, FIG. 1*d* shows the tube system mounted on the support plate by the heat-conducting elements, FIG. 1*e* shows a rear view of FIG. 1*d*.

DETAILED DESCRIPTION OF THE INVENTION

Figures 1A, 1B, 1C, 1D, 1E:
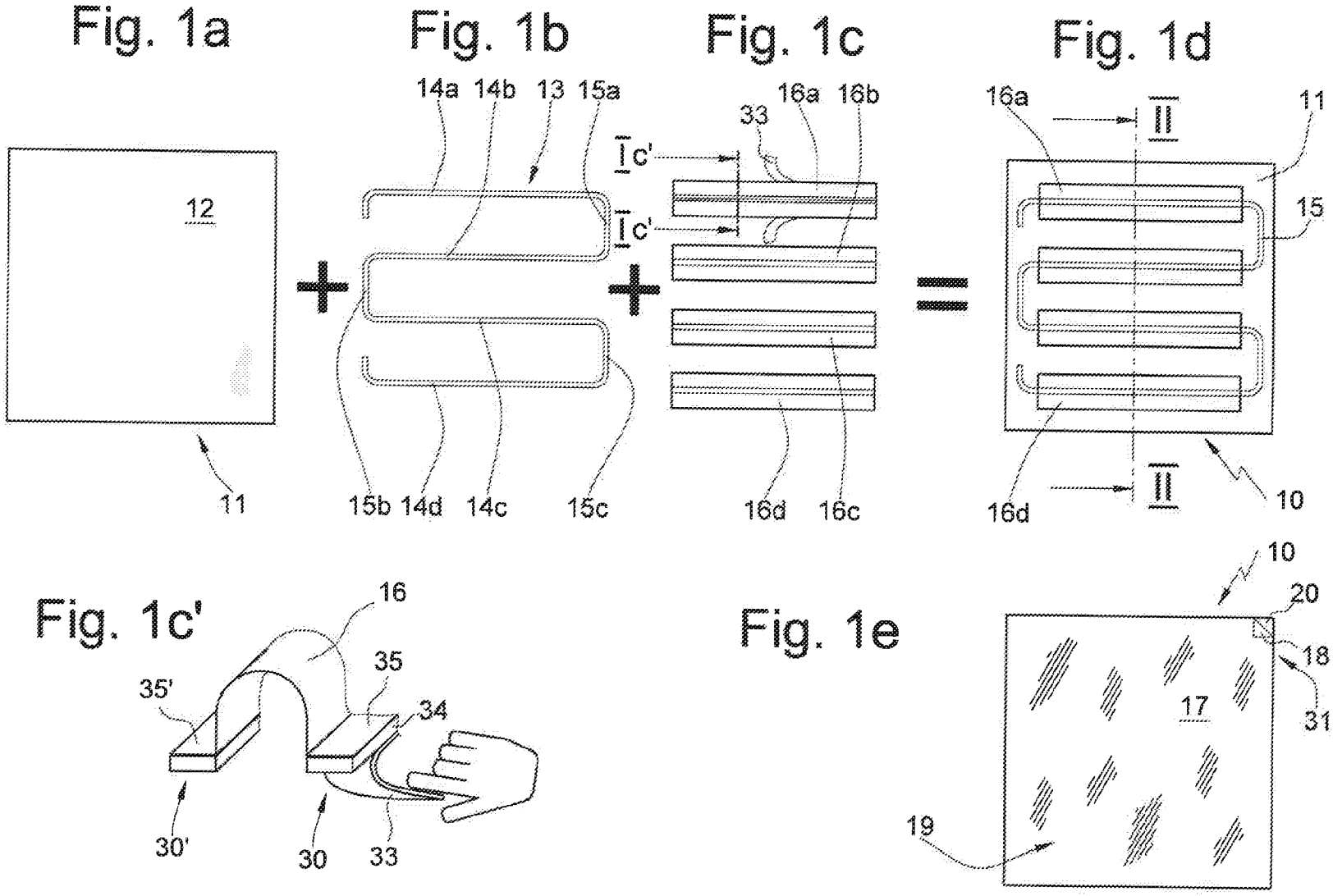
FIGS. 1*a*-1*e* show, in a series of schematic plan views, the basic components and the production sequence of an intermediate product according to the present invention.

Embodiments of the invention are described by way of example in the following description of the figures, also with reference to the drawings. Here, for the sake of clarity, even if different embodiments are involved, identical or comparable parts or elements or regions have been denoted by identical reference signs, sometimes with the addition of lower-case letters or apostrophes.

Features that are only described in relation to one embodiment can also be provided in any other embodiment of the invention within the scope of the invention. Even if they are not shown in the drawings, such amended embodiments are covered by the invention.

All the features disclosed are essential to the invention per se. The content of the disclosure of the cited documents and the prior art devices described are hereby incorporated into the disclosure of the application in their entirety, also for the purpose of incorporating individual features or a plurality of features of these documents into one or more claims of the present application.

First, the series of figures in FIG. 1 shows the manufacture of an intermediate product 10 according to the invention by the manufacturer (cf. FIGS. 1*d* and 1*e*).

According to FIG. 1*a*, a support plate 11 is first used for the production thereof, for example in the manufacturer's production facilities. The support plate 11 is shown in FIG. 1*a* by way of its front side 12 and consists substantially of a metal sheet, for example made of aluminium. Here, the support plate 11 preferably has a material thickness of at least 0.3 mm, and in the present embodiment approximately 0.5 mm or 0.6 mm. This material thickness in particular ensures that the support plate 11 can also be described as a metal transfer sheet, since the material thickness provided allows for optimal thermal conduction in the support plate.

According to FIG. 1*b*, a tube system 13 in the manner of a tube meander is provided on the front side 12 of the support plate 11. Here, the tube system 13 shown in particular comprises four straight tube portions 14*a*, 14*b*, 14*c*, 14*d*, which typically exhibit a D-shaped cross section. The three substantially curved portions 15*a*, 15*b*, 15*c* arranged therebetween may, however, retain a round cross section, for example. According to FIG. 1*d*, this tube system 13 is attached to the support plate 11 by means of heat-conducting elements, for example in the manner of heat-conducting sheets 16*a*, 16*b*, 16*c*, 16*d*, as shown in FIG. 1*c*. In this case, the heat-conducting sheets 16*a*, 16*b*, 16*c*, 16*d* are in particular strip-shaped and can each engage over a straight tube portion 14*a*, 14*b*, 14*c*, 14*d* and attach to the support plate 11.

In this sense, in the present embodiment, the curved tube portions 15 are in particular not attached directly to the support plate 11, but instead are only indirectly attached via the straight portions 14 and the heat-conducting sheets 16. The heat-conducting sheets 16 are adhered to the support plate 11 (in particular on both sides of the covered tube portion). Therefore, the heat-conducting sheets may in particular be metal strips having good heat-conducting properties.

The intermediate product assembled in this way is shown in FIG. 1*d* in a front view and in FIG. 1*e* in a rear view.

The rear view according to FIG. 1*e* shows that the rear side 19 of the intermediate product 10 and therefore also the rear side of the support plate 11 is provided with a protective layer 17, for example a peel-off film or a peel-off piece of paper coated with silicone, or the like. The protective layer 17 is part of an adhesive tape 31 and serves to cover and protect an adhesive body 20 (virtually not shown in FIG. 1) of the adhesive tape 31 that is arranged on the rear side of the intermediate product 10 and the support plate 11. The intermediate product 10 is intended to be adhered to a retaining cassette using this adhesive tape 31 in the manner described later.

Typically, to ensure that it is easy to remove or peel off, the protective layer 17 comprises a grip face 18, which may for example be provided by a protruding film region or simply a region of the underside of the film (which is associated with the adhesive body 20).

When FIGS. 1*c* and 1*c*' are considered together, it can also be seen that, in addition to the adhesive tape 31, the intermediate product also provides the use of another, support-free adhesive tape in the form of an adhesive strip 30. The heat-conducting elements 16 can be adhered to the front side 12 of the support plate 11, namely likewise by means of a double-sided, support-free adhesive tape 30.

Here, FIG. 1*c*' shows that an adhesive strip 30 can be attached to each tab base 35 of a heat-conducting element 16. For the purpose of installing the heat-conducting element 16 on the support plate 11, a strip protective layer 33 can be manually peeled off, such that the heat-conducting element 16, which engages over the tube system 13, can be adhered to the front side 12 of the support plate 11 by means of the exposed strip adhesive body 34.

With regard to FIG. 1*c*', it is noted that, for the sake of clarity, the strip protective layer 33 is shown as already having been peeled off from the adhesive strip 30' shown on the left.

Therefore, the adhesive strip 30 can come from the same adhesive tape source as the adhesive tape 31 which is associated with the other side 19 of the support plate 11. Optionally, however, it is fabricated in a different way, for example in a strip form rather than in a sheet form, or, however, identical strips can be used on both sides of the support plate 11, and therefore typically a plurality thereof can be used on the side 19.

The finished intermediate product 10 according to FIG. 1*d*/*e* is typically manufactured separately by a surface heat exchanger manufacturer. It is, however, intended to be inserted into a retaining cassette which is not located at the manufacturer's site according to the invention.

In this sense, the intermediate product denoted by reference sign 10 in FIG. 1 constitutes an easy-to-handle, transportable and easy-to-store unit which can be shipped or transported in a logistically simple manner (since shipping without the particularly heavy retaining cassette is possible, for example).

Typically, the easy-to-handle intermediate product denoted by reference sign 10 in FIG. 1 for assembling a surface heat exchanger is then transported to another/a remote site, at which the assembly of the surface heat exchanger takes place (by bringing together the intermediate product and a retaining cassette), as shown in particular in the series of FIGS. 2 to 5.

Figure 2:
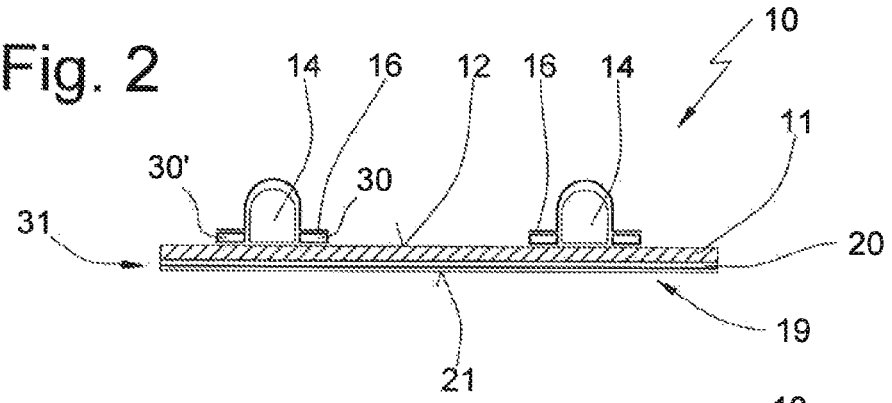
FIG. 2 is a highly schematic view, roughly along arrow II in FIG. 1, of a section through the intermediate product according to the invention, omitting some tube portions.

Here, FIG. 2 is a cross-sectional view through the intermediate product 10 approximately according to the arrows II in FIG. 1*d*, but with two straight tube portions being omitted. Therefore, for the sake of clarity, only two of the actual four straight tube portions 14 of the tube system 13 are shown in FIG. 2 by way of example. According to FIG. 2, the tube portions 14 are D-shaped in cross section and are fastened to the front side 12 of the support plate 11 by the heat-conducting sheets 16, on either side in the present embodiment (by an adhesive strip 30, 30' that does not have a protective layer and is free of any support).

FIG. 2 also shows that the adhesive tape 31 is arranged on the rear side or underside 19 of the support plate 11, the adhesive body 20 of which is covered by a protective layer 21, in particular over its entire surface. The protective layer 21 is used in particular to make it easier to handle and transport the intermediate product 10 in the sense that the intermediate product 10 does not adhere to another object during transport due to the adhesive body 20.

The intermediate product 10 shown in FIG. 2 is then already at a second site, wherein this is possibly the installation site, for example, i.e. the building room in which the surface heat exchanger is intended to be attached, for example. In principle, this may, however, be the installation site only in the sense that the assembly of the surface heat exchanger takes place in a neighbouring room, a neighbouring building or outside the destination building or in a space adjacent to the destination room. Alternatively, the second site may also be (slightly) different from the installation site. For example, the finished intermediate product 10 according to FIG. 2 may first be transported from the locality of the manufacturer to a locality of an installer which is in the vicinity of the installation site.

Figure 3:
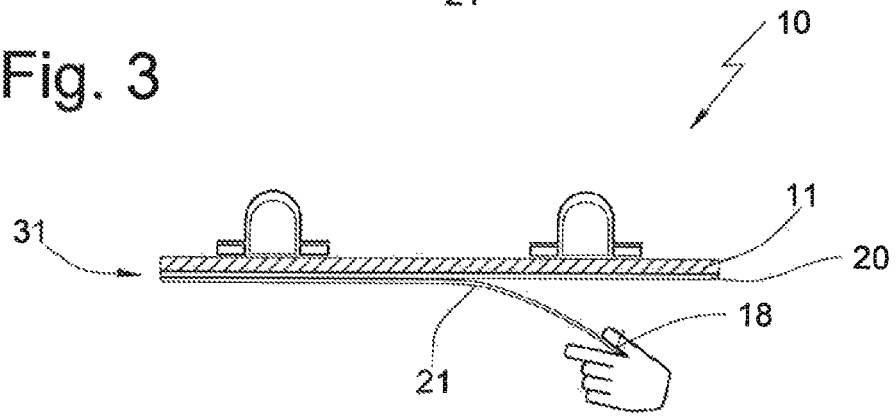
FIG. 3 is a view according to FIG. 2 of the intermediate product with the protective layer having been partially peeled off.

In any case, according to FIG. 3, the protective layer 21 or protective film 21 can be easily manually removed or peeled off at a second site, which is advantageously the installation site. In this way, the adhesive body 20 of the intermediate product 10 is exposed. To do this, a user can use their hand to engage behind a grip face 18 of the protective layer 21.

After removal of the protective layer 21, a black colour impression, for example, can then appear when looking at the underside of the support plate 11. This colour impression can be produced by a black-coloured adhesive body 20 of the adhesive tape 31, for example, or in an alternative embodiment (not shown), by a separate coating on the underside of the support plate 11 which would thus be arranged between the support plate 11 and the adhesive body 20, wherein a substantially transparent adhesive body has to be used in this case.

Figure 4:
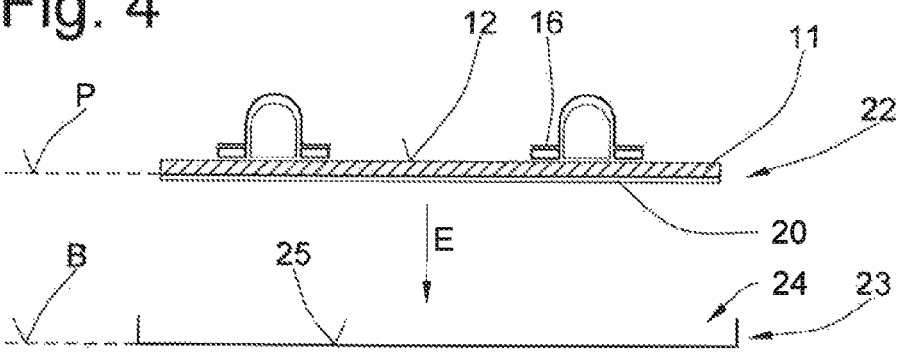
FIG. 4 is a view according to FIG. 3 of the intermediate product, or the remainder thereof, with the protective layer having been peeled off and said intermediate product being inserted into a retaining cassette.

The protective layer 21 is preferably removed according to FIG. 3 immediately before the remainder 22 of the intermediate product is adhered into or onto the retaining cassette 23, as shown in FIG. 4. The remainder 22 of the intermediate product 10, in particular comprising the exposed adhesive body 20, the support plate 11 and the tube system 13 and the heat-conducting sheets 16, can then be brought closer to the inner face 24 of the retaining cassette in an insertion direction E and can be adhered thereto, in particular over its entire surface, by means of the exposed adhesive body 20 of the adhesive tape 31. In this case, this adhesion takes place in a substantially plane parallel manner by the plate plane P being brought towards the attachment plane B of the retaining cassette 23 in a plane parallel manner until it adheres to an attachment face 25 of the retaining cassette 23. No tools, aids or the like are generally required for this purpose. A user can do this manually, in particular by exerting pressure on the rear side 24 of the support plate approximately in the insertion direction E after placing the remainder 22 of the intermediate product 10 into or onto the retaining cassette 23 or the attachment face 25.

Figure 5:
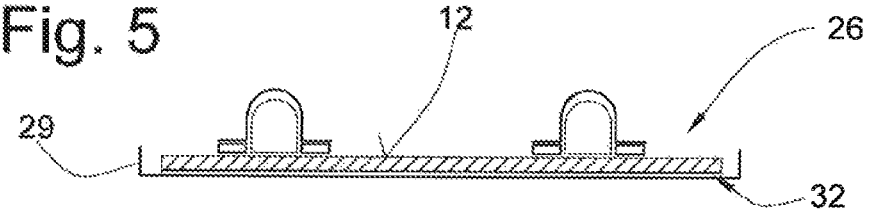
FIG. 5 is a view according to FIG. 4 of an assembled surface heat exchanger according to the method according to the invention.

The assembled surface heat exchanger is then denoted by reference sign 26 in FIG. 5. This in particular comprises an adhesive tape 32 that does not have a protective layer (which corresponds to the adhesive tape 31 without the protective layer 17, i.e. the adhesive body 20).

Another embodiment, which provides that the attachment face 25 of the retaining cassette 23 is provided by a preferably black non-woven material that is arranged in the retaining cassette, is not shown in FIGS. 4 and 5. This optional non-woven material has acoustic and visual properties, inter alia, and can be inserted into the cassette 23 in advance in a separate method step.

If the surface heat exchanger 26 has been assembled according to FIGS. 2 to 5 remotely from the installation site, the surface heat exchanger 26 can then be transported from the second site, for example the site of the local installer, to the installation site, in particular the intended building room. If, however, the surface heat exchanger 26 has been assembled at the installation site, the final installation of the assembled surface heat exchanger 26 can then (according to FIG. 6) be carried out.

Figure 6:
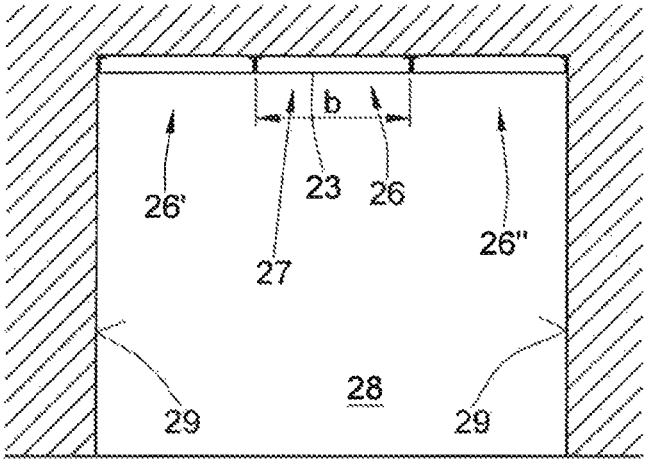
FIG. 6 is a highly schematic lateral sectional view through a building room in which the assembled surface heat exchanger according to FIG. 5 has been mounted centrally, omitting the (remainder of the) intermediate product for the sake of clarity.

FIG. 6 shows the surface heat exchanger 26 in a completely installed state, in which the surface heat exchanger 26 has been attached or fastened to a ceiling 27 of a building room 28. For the sake of clarity, however, FIG. 6 only shows the retaining cassette of the surface heat exchanger 26, without the remainder 22 of the intermediate product 10. However, the fully installed surface heat exchanger 26 of course contains all the components shown in FIG. 5.

To install the surface heat exchanger 26, the retaining cassette 23 may for example comprise installation faces, which are indicated in FIG. 6 and are omitted from FIG. 5 for the sake of clarity, and can in particular be attached to the side edges 29 of the retaining cassette 23 (cf. FIG. 5).

In FIG. 6, the surface heat exchanger 26 is installed on the ceiling 27 in a cascaded arrangement together with other surface heat exchangers 26' and 26". The complete installation also includes, inter alia, the surface heat exchanger 26 being connected to the other surface heat exchangers 26' and/or 26" with regard to its tube system, such that continuous conduction of a fluid flowing through the tube system 13 on the ceiling 27 is ensured.

With regard to FIG. 6, it is noted that many more or less than three of the surface heat exchangers shown can of course be used on the ceiling. In particular, the surface heat exchangers may not only be arranged beside one another, as shown in the sectional view according to FIG. 6, but may also be arranged in succession in relation to the other spatial direction.

It is common to all the forms of arrangement that the surface heat exchangers 26 form what is known as a climate-control ceiling, which provides air conditioning of the room 28. If a coolant, for example cooled or cold water, flows through the tube systems or tube system, the climate-control ceiling can have a cooling effect. If, however, the room 28 is intended to be heated, a heated medium, for example hot water, can flow through the tube systems 13 of the surface heat exchangers 26.

Merely for the sake of clarity, it is noted with regard to FIG. 6 that the surface heat exchangers 26 could of course also be arranged on the walls 29, depending on the application.

In this case, a typical surface heat exchanger 26 has a width b of approximately 60 cm, in particular of between 50 and 70 cm. The surface heat exchanger 26 may have identical dimensions in the other spatial direction or, alternatively, may typically also have dimensions that are approximately twice as long, i.e. a length of approximately 120 cm or in particular between 100 cm and 140 cm. Typically, in this case, precisely one (remainder of the) intermediate product 22 is arranged within a retaining cassette or an intermediate product is installed within said retaining cassette.

Figure 7:
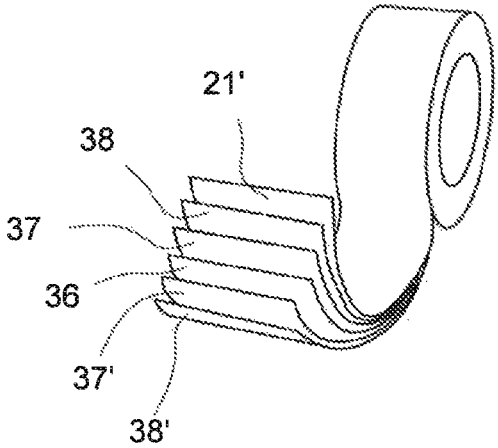
FIG. 7 is a highly schematic, perspective view of a double-sided adhesive tape, as used in the prior art.
Figure 8:
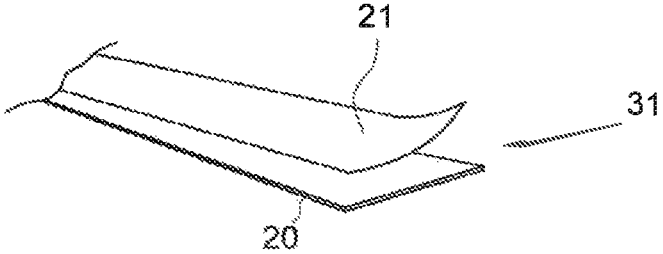
PRIOR ART Fig. 8
FIG. 8 is a highly schematic, perspective view of a support-free, double-sided adhesive tape, as used in the invention, but for the sake of clarity not with the correct dimensions and layer thicknesses.

FIGS. 7 and 8 show, highly schematically and in portions in some cases, the difference between a double-sided transfer adhesive tape, as used according to the invention (FIG. 8), and a double-sided adhesive tape comprising a support from the prior art (FIG. 7).

While the adhesive tape 31 according to FIG. 8 used according to the invention merely comprises an adhesive body 20 and a protective layer 21 (wherein, for the sake of clarity and owing to the schematic representation, these are not shown to scale in particular in relation to their thickness and are not shown in the correct ratio relative to one another either), a double-sided support tape comprising a support, as shown in FIG. 7, consists of many more layers: said tape thus comprises a central support 36 and a layer of primer material 37 and 37' on either side. This serves to attach the respective adhesive masses 38 and 38' to the support 36. According to FIG. 7, the adhesive tape comprising the support then comprises a protective layer 21'.

The large number of different layers alone suggests that the double-sided adhesive tape comprising the support according to FIG. 7 is thicker overall and for example has a total thickness of greater than 0.2 mm, while the support-free adhesive tape 31, as used in the invention, has a considerably lower total thickness, for example of less than 0.15 mm.

Even if this cannot be seen from FIG. 8, in reality it can be provided that the adhesive body 20 in the adhesive tape 31 has a lower thickness of approximately 0.06 mm, for example, than the protective layer 21 (which can consist of silicone paper, for example, and can have a thickness of approximately 0.08 mm).

Figure 9:
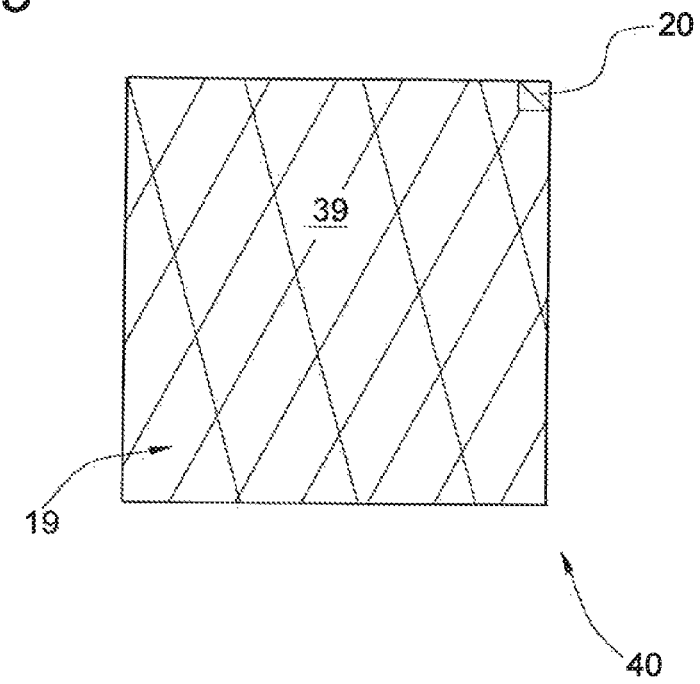
FIG. 9 is a bottom view, for example according to FIG. 1*e*, of a surface heat exchanger according to the invention comprising a decorative layer attached to the support plate.

Lastly, FIG. 9 shows a bottom view in another embodiment, which corresponds to a view approximately according to FIG. 1*e*, in which the underside 19 of the carrier plate does not, however, comprise (or no longer comprises) a protective layer, but instead already comprises a decorative layer 39 arranged thereon.

In the embodiment shown, this decorative layer 39 is a non-woven material, in particular an acoustic non-woven material, for example.

In this case, according to FIG. 9, the decorative layer 39 in particular has a pattern (which is checked in this example) which can be printed onto the decorative layer or the non-woven material, for example.

FIG. 9 does not show the microperforations in the decorative layer 39, however, which in principle serve to improve the acoustic properties of the surface heat exchanger 40 as a whole.

The decorative layer 39 is adhered to the underside 19 of the surface heat exchanger 40, and specifically by the adhesive body 20 of the adhesive tape 32 indicated at one corner in FIG. 9.

Normally, in this case, as shown in FIG. 9, the decorative layer 39 of course does not have a "dog ear" in the region of one corner. This view is merely intended to show that, below the decorative layer 39, but above the underside 19 of the support plate 11, there is also the adhesive body 22, by means of which the decorative layer 39 is directly fastened to the underside 19 of the carrier plate 11.

As shown in this view of the underside 19 of the support plate 11 or the slightly modified surface heat exchanger 40 that is shown, as a whole, this is also an easy-to-handle, ready-to-use and transportable unit which is produced at the first site. Therefore, a surface heat exchanger 40 according to the invention can be transported to the intended site in a logistically simple manner.

The production of a surface heat exchanger 40 of this kind comprising a decorative layer essentially corresponds to the production as shown in FIG. 1, after which, however, the protective layer 17 is peeled off and the decorative layer 39 is attached.

In order to install a surface heat exchanger 40 of this kind comprising a decorative layer 39, it may for example comprise installation means or may interact with room-side or ceiling-side installation means. It is typically not adhesively bonded into a retaining cassette, since the underside comprising the decorative layer 39 is intended to be visible.

The invention claimed is:

1. An intermediate product for production of a surface heat exchanger, comprising: a support plate; a tube system for conducting a medium attached on one side of the support plate; and a prefabricated adhesive tape attached on another side of the support plate, when the prefabricated adhesive tape has a manually removable outer protective layer, wherein the adhesive tape is free of any support.

2. The intermediate product according to claim 1, wherein the adhesive tape is substantially free of cavities in a region between the protective layer and an adhesive body.

3. The intermediate product according to claim 1, wherein the adhesive tape comprises the protective layer and the adhesive body.

4. The intermediate product according to claim 1, wherein the adhesive tape consists of the protective layer and the adhesive body.

5. The intermediate product according to claim 3, wherein the adhesive body has a thickness of less than 0.1 mm.

6. The intermediate product according to claim 5, wherein the adhesive body has a thickness of less than 0.07 mm.

7. The intermediate product according to claim 3, wherein the adhesive body comprises acrylate adhesive.

8. The intermediate product according to claim 3, wherein the adhesive body comprises foam.

9. The intermediate product according to claim 3, wherein the adhesive body comprises polyurethane, PVC and/or polyethylene foam.

10. The intermediate product according to claim 1, wherein the adhesive tape is an acrylate foam adhesive tape.

11. The intermediate product according to claim 1, wherein the adhesive tape is a transfer adhesive tape.

12. The intermediate product according to claim 1, wherein the adhesive tape has a total thickness of less than 0.2 mm.

13. The intermediate product according to claim 12, wherein the adhesive tape has a total thickness of less than 0.15 mm.

14. The intermediate product according to claim 1, wherein exactly one prefabricated adhesive tape having a manually removable outer protective layer is arranged on said another side.

15. The intermediate product according to claim 1, wherein a plurality of prefabricated adhesive tapes having a manually removable outer protective layer are arranged on said another side.

16. The intermediate product according to claim 1, further comprising at least one heat-conducting element that attaches the tube system for conducting the medium to the support plate.

17. The intermediate product according to claim 16, wherein the heat-conducting element is a heat-conducting sheet.

18. The intermediate product according to claim 16, wherein the heat-conducting element is attached to the support plate by an additional prefabricated, support-free adhesive tape.

19. The intermediate product according to claim 1, wherein the tube system for conducting the medium is directly attached to the support plate.

20. The intermediate product according to claim 1, wherein the support plate is metal.

21. A surface heat exchanger, comprising an intermediate product according to claim 1, wherein the prefabricated adhesive tape attaches the support plate in or on a retaining cassette, wherein the adhesive tape is free of any support.

22. A surface heat exchanger, comprising: a support plate; a tube system for conducting a medium attached on one side of the support plate; at least one heat-conducting element that attaches the tube system to the one side of the support plate; and a prefabricated adhesive tape that attaches the heat-conducting element to the one side of the support plate, wherein the adhesive tape is free of any support.

23. A surface heat exchanger, comprising: a support plate; a tube system for conducting a medium attached on one side of the support plate; at least one heat-conducting element that attaches the tube system to the one side of the support plate; a first prefabricated adhesive tape arranged on an other side of the support plate to attach the support plate in or on a retaining cassette; and a second prefabricated adhesive tape that attaches the heat-conducting element to the support plate, wherein the first adhesive tape and the second adhesive tape are each a support-free adhesive tape.

24. A surface heat exchanger, comprising: a support plate; a tube system for conducting a medium attached to one side of the support plate; and a prefabricated adhesive tape arranged on an other side of the support plate to attach an outer decorative layer to said other side, wherein the adhesive tape is free of any support.

* * * * *